United States Patent [19]

Evans

[11] Patent Number: 4,630,572

[45] Date of Patent: Dec. 23, 1986

[54] BOILING LIQUID COOLING SYSTEM FOR INTERNAL COMBUSTION ENGINES

[75] Inventor: John W. Evans, Sharon, Conn.

[73] Assignee: Evans Cooling Associates, Sharon, Conn.

[21] Appl. No.: 625,919

[22] PCT Filed: Nov. 14, 1983

[86] PCT No.: PCT/US83/01775

§ 371 Date: Jun. 13, 1984

§ 102(e) Date: Jun. 13, 1984

[87] PCT Pub. No.: WO84/01979

PCT Pub. Date: May 24, 1984

Related U.S. Application Data

[63] Continuation-in-part of Ser. No. 442,721, Nov. 18, 1982, abandoned.

[51] Int. Cl.[4] ..... F01P 3/22

[52] U.S. Cl. ..... 123/41.21; 123/41.82 R; 252/75

[58] Field of Search ..... 123/41.2, 41.21, 41.26, 123/41.42, 41.72, 41.54, 41.19, 41.82 R; 252/75

[56] References Cited

U.S. PATENT DOCUMENTS

| | | | |
|---|---|---|---|
| 1,789,540 | 1/1931 | Brubaker | 123/41.72 |
| 1,806,382 | 5/1931 | Barlow | 123/41.54 |
| 2,353,966 | 7/1944 | Newcombe | 123/41.19 |
| 2,403,218 | 7/1946 | Hanners | 123/41.26 |
| 3,102,516 | 9/1963 | Gist et al. | 123/41.42 |
| 3,731,660 | 5/1973 | Leffert | 123/41.42 |
| 4,404,113 | 9/1983 | Peters et al. | 252/75 |

*Primary Examiner*—William A. Cuchlinski, Jr.
*Attorney, Agent, or Firm*—Brumbaugh, Graves, Donohue & Raymond

[57] ABSTRACT

A reduction of hot spots in the combustion chambers and the simultaneous elevation of bore temperature in an internal combustion engine are achieved by a boiling liquid cooling process in which a high molecular weight, high saturation temperature organic coolant is supplied to the coolant jacket of the engine head entirely in the liquid state, thereby greatly reducing the ratio of vapor to liquid in the head jacket for more effective heat transfer from the head to the coolant.

14 Claims, 7 Drawing Figures

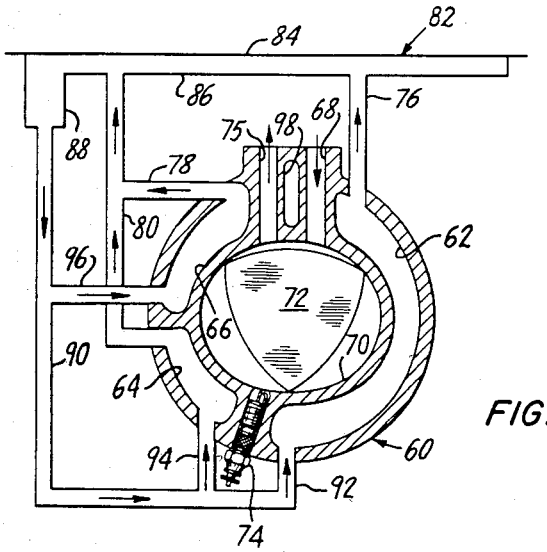
FIG. 5
FIG. 6
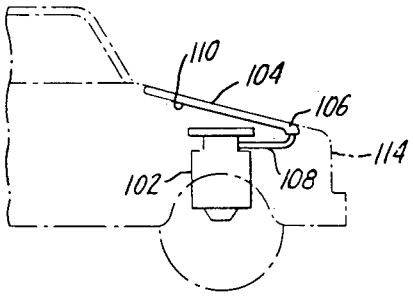
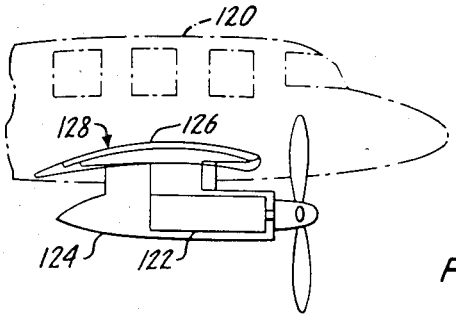
FIG. 7

BOILING LIQUID COOLING SYSTEM FOR INTERNAL COMBUSTION ENGINES

This application is a continuation-in-part of application Ser. No. 442,721, filed Nov. 18, 1982, and now abandoned.

DESCRIPTION

Technical Field

The present invention relates to a cooling system for internal combustion engines that significantly increases the efficiency of and reduces the undesired emissions from the engine and is less expensive to make, install and maintain than conventional cooling systems. The system also makes it possible to improve the aerodynamic efficiency of vehicles by greatly reducing or eliminating the drag of a cooling air intake.

BACKGROUND ART

Effect of Temperature on Engine Performance

It is well known that the efficiency of the internal combustion engine is greatly affected by temperature. It is for this reason that a major modification of the engine cooling system may have a first-order effect on engine performance. In general internal combustion engines, whether diesel or spark-ignition, are "heat engines" and operate more efficiently when hot. Accordingly, current design convention seeks to provide for attainment of temperatures of the walls of the cylinder bores at as high a level as possible. For this reason present-day liquid-coolant systems are operated under pressure. Pressure raises the boiling point of the liquid, and accordingly the coolant may be operated at higher temperatures without "boiling over."

In conventional cooling systems, however, there is a penalty for high bore temperatures—temperatures at the cylinder head are also increased. This tends to cause premature ignition of the fuel charge, which most drivers recognize as "knocking", and localized heat damage such as metal cracks. Further insight into temperature effect is gained from consideration of what happens to the energy of the fuel supplied to the engine of an automobile. It is roughly as follows:

Heat rejection in the exhaust gas—33%
Heat rejection in engine cooling—29%
Indicated horsepower—38%

The indicated horsepower is partly consumed by pumping gases into, through and out of the combustion chambers and out the exhaust pipe (6% of total energy input), piston ring friction (3%), and other engine friction (4%), leaving an engine brake horsepower of 25% of energy in. In the case of automobiles, by far the largest field of use of internal combustion engines, only about one-half of the brake horsepower is ultimately used to move the automobile. The other half is lost in coasting, idling and braking, in drive train friction and other losses and in powering accessories. About one-half of the energy at the wheels is used to overcome aerodynamic drag and the rest tire friction and hysteresis.

Engine temperature affects cylinder cooling heat rejection and thermodynamic cycle efficiency in various ways. Engine temperature also affects friction losses. The requirement in conventional vehicles of a radiator cooled by ambient air flow increases aerodynamic drag, relative to the more efficient body shapes that could be used if the cooling air intake for the radiator were eliminated.

Basic Engine Cooling Requirements

The primary purpose of an engine cooling system is to keep the engine within maximum and minimum temperature limits under varying loads and ambient conditions.

The combustion process in an engine causes excessively high temperatures around the mixture ignition areas, normally in the top part of the combustion chamber in piston engines, and exhaust valve seat and port surfaces. Excessive temperatures in these areas cause surface ignition, leading to engine knock, mechanical failures of engine materials, and increases in HC (hydrocarbon) and $NO_x$ (oxides of nitrogen) emissions. Excessive cooling of the engine adversely affects fuel consumption, exhaust emissions of HC and CO, deposits, and vehicle driveability. Temperature differences throughout the engine cause thermal distortion and stress, which lead to engine wear, leakage, and failure. The ideal cooling system, therefore, balances these factors in order to maintain a temperature that is high enough to promote fuel economy, minimize emissions, maintain driveability, etc., low enough to eliminate preignition and mechanical failure and uniform enough to eliminate thermal distortion and its resulting problems.

In addition to the cooling requirements for an engine operating under steady state conditions, as described above, a cooling system has further complicating requirements. The temperature of the engine has a tendency to increase with an increase in engine load. These load increases may be due to increased speed, road grade changes, additional weight in the vehicle, or many other causes. In addition, the ambient temperature increases have an adverse effect on engine temperatures since the temperature differential between the engine and the cooling air is reduced. For all of the above reasons, a cooling system which can maintain a uniform temperature in spite of varying engine loads and ambient conditions is the design objective.

Types of Cooling Systems

The radiative and convective heat transfer from combustion gases to the combustion chamber walls, the conductive heat transfer through the combustion chamber walls to other parts of the engine and the heat transfer area between the engine metal and the cooling system are all variables determined by engine design. As such, these factors are beyond the control of the cooling system design, and are assumed to be constant for purposes of comparison among various types of cooling systems.

Air Cooling Systems

Due to the low order of the heat transfer coefficient of air, a large volume of air flowing over the heat transfer area is required to reduce the temperature in an engine. This method of cooling is generally unsatisfactory in an automotive engine due to the wide variations in ambient conditions, e.g., ambient temperature and vehicle speed, and engine speeds and the difficulty in maintaining any control over engine temperature. As the vehicle speed increases, the volume of air flowing over the engine also increases, and as the vehicle speed decreases or the vehicle stops, the volume of air, even enhanced by a large fan, decreases; consequently, the cooling effect decreases. Additionally, finned areas create local hot spots between fin-to-bore contact points. It is difficult to maintain the engine temperature within required limits, thus making this cooling method ineffective for surface vehicles. Because air temperatures at high altitudes are very low, air cooling is generally satisfactory for aircraft, though there are advantages to be derived from liquid cooling of aircraft engines.

Liquid Cooling Systems

The liquid cooling system is the system most commonly used to control the temperatures in internal combustion engines. Conventional liquid cooling systems are pressurized, with forced circulation of a liquid coolant by means of an engine-driven pump. The closed loop system circulates the liquid coolant between the engine water jacket, where heat is transferred to the coolant from the combustion chambers, and a radiator, where heat absorbed by the coolant in the engine is transferred to air flowing through the radiator. A pressure relief valve in the radiator fill cap is set at a pressure high enough to raise the coolant boiling point, thus preventing the liquid coolant from escaping under the normal range of engine operating temperatures.

To reduce engine warm-up time, a thermostatic valve is located at the outlet of the engine water jacket. The thermostatic valve opens only when the temperature exceeds a predetermined value. At coolant temperatures below the preset value of the thermostatic valve, little or no coolant can flow to or from the engine, so that the temperature of the relatively small portion of the total coolant that is trapped in the engine jacket will rise rapidly, and the engine can operate more efficiently sooner after a cold start.

Although conventional pressurized single-phase liquid coolant systems are reliable and require relatively little maintenance, they have several inherent drawbacks. Surface convective heat transfer coefficients for a fluid in the liquid phase are relatively low and vary with flow velocity. In the typical automotive cooling system, cooled liquid from the radiator enters the engine water jacket at the lower front part of the engine, and heated liquid leaves from the top of the engine. Therefore, the front cylinders will run cooler than the rear cylinders. Also, it is difficult to maintain uniform flow velocity of the liquid coolant through the complex flow passages inside the cooling jacket, so local hot spots develop throughout the engine. These hot spots are believed to contribute to the production of oxides of nitrogen in the engine exhaust gases.

Since the highest temperatures are generated in the combustion chambers at the tops of the cylinders, and since the coolant flow is generally upward through the engine, the upper part of each cylinder is much hotter than the lower part. This temperature differential from top to bottom of the cylinder causes thermal distortion of the engine block and cylinder head with consequent increased blow-by and oil consumption. Another problem caused by top-to-bottom temperature differentials is that of wall quenching, which produces an unburned layer of gases on the relatively cooler lower cylinder walls. This is a source of excessive carbon monoxide and unburned hydrocarbons in the exhaust gases. It also results in poorer fuel efficiency. Additionally, liquid systems are highly sensitive to ambiant temperature changes on a directly proportionate scale.

Evaporative Cooling Systems

Evaporative cooling (known also as boiling liquid or ebullient cooling) of internal combustion engines has been known for at least seventy years and has been the subject of numerous efforts over those years to develop a system that fulfills the many functional requirements for engine cooling systems in a reliable, effective, low-cost, practical way. Despite those efforts boiling liquid cooling has had virtually no commercial application. Some automobiles with boiling liquid cooling systems were built in the 1920's, and boiling liquid cooling has been applied to some extent to stationary engines, such as those used in the drilling industry, within the last twenty-five years. Nonetheless, there are some generally recognized advantages to boiling liquid cooling.

One of the advantages of a boiling liquid cooling system is that the convective heat transfer coefficients for vaporizing and condensing the coolant are an order of magnitude greater than the coefficient for raising the temperature of a circulating liquid coolant without boiling. Therefore, the temperature of the coolant in an evaporative system tends to be virtually the same in all parts of the engine.

In typical boiling coolant systems, liquid coolant is boiled within the cooling jacket of the engine, and the vaporized coolant is withdrawn from the upper part of the cooling jacket and conducted to an air-cooled radiator or condenser, either directly or through a vapor-liquid separator tank. The condensate collects in a sump connected to the bottom of the condenser and is returned to the inlet of the engine cooling jacket or to a supply tank for gravity flow to the engine.

Since boiling occurs at a constant temperature (assuming constant pressure), and since surface convective heat transfer coefficients for fluids being converted to the vapor state are much higher than those for the same fluids kept in the liquid state, boiling liquid cooling systems can maintain cylinder wall temperatures more nearly constant from top to bottom. In addition, the entire cylinder wall will usually be hotter, thereby reducing the production of carbon monoxide and unburned hydrocarbons in the exhaust gases, reducing friction, and improving fuel economy.

There are, however, several disadvantages to conventional pressurized evaporative cooling systems. An inherent major problem is loss of coolant supply in those systems due to vapor loss through vents or pressure relief valves and greater risk of high pressure leaks in the system. Many vapor cooling system produce an excessive volume of vapor in order to maintain the engine at the desired temperature level (100°-116° C., 212°-240° F.). In a high pressure system, the condenser, where the vapor is condensed back to a liquid state, may restrict fluid flow, thereby causing back pressure and vapor build-up in the engine cooling jacket. This back pressure displaces the liquid coolant in the engine cooling jacket with vapor, and contributes to engine failure through loss of cooling in the region where vapor has displaced liquid phase coolant. A further problem with most previous systems is the need for condenser fans and circulating pumps, either mechanical or electrical. It is because of these and other problems that previous vapor cooling systems have not, since the early days of the automobile, been commercially used in automotive engine cooling systems and little used in other fields.

Particular Prior Art References

There is, of course, a substantial body of patent, technical and lay literature on the subject of boiling liquid cooling for internal combustion engines. A few of these documents warrant a brief discussion here, because certain of the embodiments of the present invention may utilize some of the concepts found in them.

One such concept is the use of a condenser, the condensing surface of which is constituted by an external skin panel of a vehicle. This idea is proposed for use in automobiles in Barlow U.S. Pat. No. 1,806,382, May 19, 1931 and for use in aircraft in Lynn et al., U.S. Pat. No. 1,860,258. The Barlow patent also describes the advantage of such a condenser of eliminating the need for a fan to blow cooling air through a tube condenser and of being able to provide a hood over the engine compartment that will reduce intrusion of dust and lessen release of fumes back toward the passenger compartment.

Another feature that is useful in the present invention is that the condenser be located at a level above the engine coolant jacket and that condensed coolant be returned to the jacket by gravity. This eliminates the need for a pump. Elevated condensers with gravity return of condensate to the engine are proposed in the Barlow patent and in Bullard U.S. Pat. No. 3,082,753.

The Basic Defect of Prior Art Systems

It is believed that a basic and fatal defect has existed in all previously proposed boiling liquid systems, namely that a major fraction of the coolant in the coolant jacket of the engine head is in the vapor phase during most operating conditions of the engine other than during warm-up. Universally, the coolant in the jacket of the engine head receives the vapor evolved from the coolant in the block. When vapor from the block is combined with the large amount of vapor evolved in the head, especially around the exhaust ports and near the dome of the combustion chamber, the total vapor content of the head coolant jacket is so high that there is insufficient liquid coolant available in places where it is most needed to extract heat by vaporizing, and hot spots develop and persist in the combustion chamber dome. The vapor in the head has little capacity to accept more heat, and vapor pockets tend to form near the hottest regions where they are the most damaging to effective heat transfer.

The problem of the presence of excessive coolant vapor in the head coolant jacket can be especially harmful in narrow portions of the jacket, such as above the exhaust ports and at the openings where the block jacket communicates with the head jacket. Even small projections on the walls of the jacket in these narrow passages can deflect the flow of liquid coolant and provide a site for a vapor pocket where a hot spot can develop and persist. These vapor pockets tend themselves to block or divert the flow of liquid coolant. Hence, the engine runs much of the time with a substantial fraction of vapor in the head coolant jacket and with insufficient coolant in the liquid phase for adequate heat transfer.

The fact that most boiling liquid cooling systems proposed and used in the past have produced a violently boiling effluent from the head, such that a lot of liquid coolant is expelled with the vapor and a vapor-liquid separation is needed, strongly suggest the presence of excessive vapor. More importantly, preignition (knocking), which is undoubtedly due to hot spots, has been a chronic problem in vapor-cooled engines—pre-ignition reduces efficiency and can cause severe engine damage and ultimate failure. This ultimately requires a retarding of the ignition spark lead (advance) for correction, which results in a loss of fuel economy. The hot spots also cause high thermal stresses that lead to cracking of the head.

DISCLOSURE OF INVENTION

There is provided, in accordance with the present invention, a solution to the problem of excessive coolant vapor in the engine head, which solution involves various aspects and is applicable to numerous embodiments. The invention, moreover, makes it possible to achieve not only the recognized advantages of boiling liquid cooling but additional advantages and unexpected results as well.

In particular the present invention is an engine cooling process that is characterized in that coolant is supplied in a liquid state substantially free of vapor to the coolant jacket of the head such that the major part of the head coolant jacket is kept filled with coolant in liquid state under all operating conditions of the engine. The process can be carried out in the following ways:

(1) The coolant used in the process has a saturation temperature above the highest temperature attained by the walls of the coolant jacket of the engine block. In this mode the process is carried out by the inherent physical property of the coolant. The coolant cannot vaporize except in the head; hence it can be supplied to the head coolant jacket from the block coolant jacket and will enter the head coolant jacket in liquid state. Suitable coolants are high molecular weight, non-aqueous organic liquids having a saturation temperature of greater than about 132° C. (270° F.) at the operating pressure of the process, some examples being ethylene glycol, propylene glycol, tetrahydrofurfuryl alcohol, dipropylene glycol and 2,2,4-trimethyl-1,3-pentanediol monoisobutyrate.

(2) The coolant is supplied to the head coolant jacket exclusively and directly from a vapor condenser that receives and condenses coolant discharged in the vapor state from the engine. In this mode the head coolant jacket is either separate from (does not communicate with) the block coolant jacket or the engine does not have a block coolant jacket.

(3) As in case (2) above, a liquid coolant is supplied directly to the head jacket exclusively from a condenser chamber. The block coolant jacket separately receives liquid coolant condensed in the same condenser chamber from coolant vapor evolved in the block and head jackets.

(4) Again as in cases (2) and (3) above, make-up coolant is supplied directly to the head jacket, but in this case as coolant condensate from a condenser chamber that receives vapor solely from the head coolant jacket. Vapor from the block coolant jacket is conducted to a second condenser chamber, and the condensate is returned from the second condenser chamber to the block coolant jacket. In short there are two vapor cooling circuits, one for the block and one for the head.

In all modes of practicing the present invention the saturation temperature should, in general, be as high as practicable, taking into account the avoidance of undesirable conditions having to do with, for example, the durability of the engine and components of the vehicle near the engine, the effectiveness and life of the engine lubricant, and engine performance, such as instability of the flame front and ignition delay, unreasonable ignition settings, pre-ignition and detonation ("knock"), excessive emissions and reduced efficiency. In general, the higher the saturation temperature of the coolant up to the limit established by the aforementioned factors, and probably other factors as well, the higher will be the bulk temperature of the engine, and the lower will be the level of heat rejection. Hence, the efficiency of the engine will be greater. It will be recognized, of course, that different engine designs may respond in different ways to different coolants, and various tradeoffs are certainly possible, if not probable, in selecting a coolant. Diesel engines, for example, do not pre-ignite as can spark ignition engines; therefore, a diesel engine equipped with a cooling system according to the process of this invention can utilize a coolant having a saturation temperature higher than coolants suitable for spark ignition engines.

As discussed briefly above, it is believed that there is a heretofore unrecognized basic and fatal defect in boiling liquid cooling systems for internal combustion engines, namely, too much coolant vapor and not enough coolant liquid in the head coolant jacket. The coolant universally proposed and used in the prior art systems is water. Even when a high boiling temperature antifreeze is mixed with the water coolant, the saturation temperature of the coolant is in the range of 104° C. to 116° C. (220° F. to 240° F.), depending upon the pressure of the system. It has been observed that block coolant temperatures would be 16° C. to 28° C. (30° F. to 50° F.) higher than this range were it not for the heat rejected by the block into the coolant jacket water. The heat rejected in this area causes the continuous conversion of liquid coolant into vapor. The vapor thus formed rises within the jacketed volume around the block and then enters the head coolant jacket, continuing to rise until finally it evolves from the top of the head jacket. To the extent that this vapor continuously occupies volume within the head jacket, liquid coolant is displaced. Under some operating conditions the head jacket contains an insufficient ratio of liquid to vapor in important areas, and cooling in these areas is inadequate.

In the first mode of the present invention described briefly above, the coolant supplied to the head coolant jacket is in the liquid state because the saturation temperature is higher than the maximum temperature of the block coolant jacket walls. Prototype cooling systems according to this invention have shown that the temperatures close to a cylinder wall at full load are 121° C. (250° F.) at the mid-stroke point and about 132° C. (270° F.) at the top-stroke point when the engine is run with the liquid phase coolant at 149° C. (300° F.). Thus, the coolant leaves the block jacket and enters the head jacket substantially in the liquid state.

In addition to mitigating the problem of excessive vapor in the head simply because no vapor enters the head from the block, there are other important beneficial effects of using a coolant having a saturation temperature that is higher than the coolant jacket temperature in the block. First, the cylinder walls are hotter than with water cooling (either liquid or boiling water), thereby providing more complete combustion of the fuel by reducing quenching (extinguishing of the flame near the cool walls of the cylinder during the power stroke). The hotter walls also mean there is less heat rejection and greater thermal efficiency and a reduction in friction due to reduced oil viscosity. The bore is of more uniform diameter from top to bottom and more uniform roundness, thereby reducing blow-by and wear of the ring grooves, the cylinder walls and the rings. The wall temperature stays well above the dew point of water vapor in the combustion gases, so there is no water condensation on the cylinder walls that can get into the oil and form sludge and acids.

The result of raising the cylinder wall surface temperature has several interrelated effects on ignition timing, flame speed, and octane requirement. Normally, elevated engine temperatures in the conventional pumped liquid-cooled engine require using high octane fuel. However, the reverse is true with the invention. The hotter cylinder wall surfaces tend to decrease ignition delay (as well as the cyclic variability of ignition delay), which markedly reduces the time required for peak combustion pressure to be achieved after ignition. The cooler cylinder head surfaces complement this by reducing "hot spots." For this reason, engines having cooling systems according to the invention tolerate considerably more low end spark advance but require significantly less total high end spark advance than conventionally cooled engines.

When the ignition timing is adjusted appropriately, the octane requirement of an engine cooled according to the invention is actually reduced. Although the cylinder-end gas is at a higher temperature, the higher flame speed combined with the elimination of hot spots on the combustion dome surface causing detonation causes the flame front to completely traverse the combustion chamber before the end gas has a chance to auto ignite. In addition, the markedly reduced cyclic variability of ignition delay allows engine operation much closer to the knock limit without occasional slow-burn or ignition-delay induced knock.

Liquid fuel will not burn. It is evident, therefore, that since fuel is introduced into the engine in liquid-droplet form, the fuel must be atomized on its way through the venturi intake manifold, intake ports, valves, during the intake stroke, compression stroke and even during combustion. It is common for a large fraction of the fuel to remain in liquid form at the time of ignition.

This causes three problems: First, the combustible mixture which is in the gaseous phase is leaner than the bulk ratio of air to fuel which was supplied by the fuel system, lowering flame speed and temperature. Secondly, the heat required to atomize that liquid fuel is stolen from the flame, lowering its speed and temperature. Thirdly, some of this liquid fuel finds its way into the quench layer, increasing the quantity of fuel which is not burned. With the cooling process of this invention the bulk engine bore (swept volume) and intake runners temperature is raised, thereby promoting more complete fuel atomization *before* the flame is initiated. This leaves more combustion energy available for conversion to work and less fuel in the quench layer. More complete fuel atomization in the intake manifold leads to better uniformity of fuel-air ratio between cylinders. This feature, in turn, allows more efficient fuel-air mixture calibrations, more satisfactory performance with alternate fuels or both. More effective fuel atomization allows for more efficient fossil fuel efficiency and is an absolute necessity when using alcohol fuels or wide-cut distillate fuels.

Enhanced mixture preparation leads to improved driveability, which allows the driver to use the throttle less aggressively and results in reduced fuel consumption. Engines equipped with the invention show a 10% to 13% improvement in fuel economy in controlled laboratory tests.

Boiling liquid cooling effects a marked decrease in unburned hydro-carbon and carbon monoxide emissions due to both the lower concentration of fuel in the quench layer and reduced thickness of that quench layer. The quench layer is well known in engine technology and is described as a layer of unburned liquid fuel approximately 0.18 mm to 0.38 mm (0.007" to 0.015") thick at the surface of the cylinder wall. Its concentration and thickness are inversely proportional to wall temperature heat level and are drastically reduced as the wall temperature rises. This occurs because at lower temperatures, about 82° C. to 93° C. (180°-200° F.), the cylinder wall is a parasite to the combustion flame, extracting (absorbing) enough heat from the flame to keep it from burning to the wall surface. The high levels of wall temperature in this invention minimize this parasitic nature of the cylinder wall by allowing the flame to burn closer to the wall and reduce the quench layer. Additionally, a decrease in carbon monoxide emissions is observed due to more complete combustion and increased flame burn time.

Normally, as cylinder head surface temperatures rise to excessive levels in an engine equipped with a conventional liquid cooling system, emissions of oxides of nitrogen tend to increase slightly with increased engine temperatures, all other variables being held constant. However, with the present invention and the increased cooling rate (capacity) of the cylinder head cooling jacket behind the combustion chamber surface allows for a lowering of cylinder head combustion chamber surface temperatures, even though the bulk engine operating temperature has been raised considerably, e.g., 38° C. (100° F.) or more. This is accomplished in that the vapor saturation of the coolant in the cylinder head jackets has been lowered to a point where there is a sufficient amount of liquid coolant free of vapor available to the critical heat areas of the head to allow the increased capabilities of heat transfer unique to boiling liquid cooling (its high coefficient of heat transfer) to keep those critical areas sufficiently cool to avoid the occurrence of hot spots on the combustion chamber surfaces of the cylinder head.

In order to minimize the amount of vapor in the head coolant jacket it is important to provide a vapor outlet conduit (or conduits) from the head coolant jacket of sufficiently large size to keep the pressure differential between the jacket and the condenser chamber low, preferably less than about 7 kPa (1 psi). Moreover, attention must be given to avoiding the possible trapping of vapor in an elevated region of the jacket in any operating position of the engine; in vehicles this means taking into account uphill and downhill operation. Two or more vapor outlet conduits or a manifold may be required in some designs.

Once these surface hot spots (which can glow red at times) are minimized or eliminated, the higher flame speed, higher combustion temperatures and pressures can be easily tolerated by the engine without causing auto ignition (detonation) and higher levels of $NO_x$, and creating a need for less high end distributor advance.

Additionally, because the thickness of the quench layer and its inherent content of raw fuel have been minimized and cylinder temperatures are higher, a greater portion of the fuel fraction of the intake change is burned, and there are less residual fuel particles left to form deposits. Typically, engines equipped with this invention show no carbon deposits after 40,000 km (25,000 miles) of operation. The elimination of carbon deposits (which also glow) minimizes early ignition (pre-ignition) and allows for more optimum ignition settings, typically an increased low end advance.

By optimization of ignition timing, air-fuel ratio, and exhaust-gas recirculation quantity, a simultaneous reduction in all three exhaust emissions and in fuel consumption is achieved.

In diesel engines ignition is timed by the injection of fuel into the combustion chambers. Hot spots on surfaces of combustion chambers, although they exist in a conventionally cooled diesel engine, will not cause pre-ignition as they will in a spark ignition engine. Nonetheless, thermal stresses in diesel engine cylinder heads due to the presence of hot spots can cause damage due to working, cracking and the erosion of material. Those thermal stresses are relieved by eliminating hot spots by application of the process of this invention.

Higher bore temperatures in diesel engines reduce the formation of exhaust particulates while simultaneously increasing the efficiency of the conversion of fuel energy to usable power. With both spark ignition and diesel engines, the increased bore temperatures which result from the application of the process of this invention yield greater engine power while at the same time the engines run cleaner.

The high boiling point coolants used in accordance with this invention have a higher molar heat of vaporization than does water. Accordingly, the quantity of vapor produced in the head is lower than with water, everything else being equal. This means fewer moles of vapor in the head jacket for a given rate of heat removal. Moreover, vapor releases from the hot walls of the jacket more readily with high molecular weight organic coolants than with water. These preferred coolants have a much lower surface tension. Thus the vapor bubbles break away from the wall more easily, making way for liquid state coolant to close quickly behind the escaping bubbles and wetting the wall. Moreover, the heat transfer from a surface being cooled to liquid being converted to vapor is several times greater when vaporization takes place directly at the heating surface (nucleate boiling) than when it takes place through a blanketing film of gas (film boiling). Observations suggest that as compared to water the use of higher saturation temperature organic coolants promote the condition of nucleate boiling rather than film boiling.

The above points add up to more effective cooling of the head due to the existance of a considerably higher ratio of liquid to vapor in the head jacket than with prior art boiling liquid cooling processes.

In a desirable mode of a system according to the invention, the condenser chamber is designed to provide for unobstructed entry and flow of the coolant vapor, to promote rapid and efficient condensation and to be located above the engine to permit gravity flow of the condensate to the engine. In this practice of the method and in embodiments of the apparatus, in which an elevated condenser provides favorable conditions for convective flow of vapor and gravity return of condensate, the cooling system has no moving parts. The elimination of a coolant pump, a fan to cool the condenser, belts with drives, all thermostats and a higher cost tube heat exchanger makes the system less costly than present pumped liquid systems and most previously known boiling coolant systems.

The condenser chamber can be also located below the vapor outlet, but this will necessitate the use of a condensate return pump. This configuration will allow placement of the condenser to the best advantage in a particular vehicle design, for example, behind the bumper of a motor vehicle or beside the engine oil pan. In such applications, the disadvantage of using a condensate return pump can be more than compensated for, as a trade-off, by, for example, optimum use of available space in the vehicle or improvement in the aerodynamics of the vehicle. No problem is presented in the process of condensing high molecular weight coolant vapor in a condenser located at a lower elevation than the area where the vapor is created, inasmuch as low molecular weight gaseous impurities, such as air or water vapor, are displaced to a level above the heavier coolant vapor while the vapor readily flows downwardly by gravity. Prior art vapor cooling systems, in contrast, have the problem that air existing within a condenser chamber located below the vapor outlet will resist being displaced by water vapor by virtue of its having a greater molecular weight than the water vapor.

The operation of the invention at ambient pressure or low pressures above ambient, say 35 kPa (5 psi), as is preferred, allows less costly and more easily installed hoses and hose fittings. The chance of coolant leakage is greatly reduced in an atmospheric or low pressure system, and if a leak does occur, the rate of coolant loss should be low enough to permit the vehicle to travel many miles for repair without an elevation in engine temperature or damage. Leaks in the hoses and condensers can easily and effectively be temporarily repaired at roadside or a service station with tape and permanent repairs deferred to a time more convenient to the vehicle owner. Field repairs to the condenser, due to its low operating pressure, may be made with a simple epoxy patch or high strength tape.

The invention is useful to great advantage in Otto cycle carburetor and fuel-injected piston engines, in Diesel engines, and Wankel engines. All of the engine types may be used in all types of vehicles, including automobiles, trucks, airplanes, self-propelled rail cars, railroad locomotives, and water craft, and in stationary applications. Stationary engines could require fan-cooling of the condenser if space is limited or a large non-forced air condenser if space is not a premium.

Vehicles embodying the present invention can be designed with reduced aerodynamic drag, because the conventional radiator cooled by air flow entering some part of the vehicle can be replaced by an external body panel. For example, the nose of an automobile or the cowling of an aircraft engine can be closed up for reduced drag, hence providing better performance with the same engine or the same performance with a smaller engine. The condenser chamber in an airplane can be built into the surface of the wing, in which case it can perform all or part of the de-icing function.

There is frequently an overheating problem with liquid-cooled airplane engines when the airplane is waiting for take-off—the radiator does not have the cooling capacity for the comparatively high ground temperature and comparatively low propeller air flow during standing and taxiing. The surface condenser can readily be designed to handle ground conditions with virtually no weight increase, and a constant engine temperature can be maintained as the aircraft climbs into cold ambients. In fact, the invention provides a weight advantage, not only in aircraft but all vehicles, because the fill of coolant is much lower than that required in a liquid cooling system of comparable capacity.

There are preferred ways of carrying out each mode of the process according to the invention. As mentioned above, there are advantages to returning condensed coolant to the head coolant jacket by gravity return from a vapor condenser chamber that has an outlet above the top of the head coolant jacket. In addition to eliminating a pump, a gravity system ensures that no vapor will be returned to the coolant jacket, provided, of course, that the condenser has sufficient capacity to condense all vapor supplied to it. In many previously proposed systems it was possible for vapor to be returned to the coolant jacket with condensate.

According to another aspect of the present invention, there is provided an improvement in vehicles powered by internal combustion engines that are boiling-liquid cooled and that, as known in the prior art, have a surface condenser chamber, one condensing surface of which is a substantially horizontally oriented upwardly facing external skin panel of the vehicle that is located at a level above the engine at all normal attitudes of the vehicle in operation. The invention is characterized in that the coolant is a high molecular weight organic liquid having a saturation temperature at atmospheric pressure of not less than about 132° C. (270° F.), and a surface tension at a temperature of 15° C. (59° F.) of less than about 70 dynes per centimeter. Examples of such coolants are referred to above.

In one embodiment the invention is further characterized in that there are separate coolant jackets for the engine block and the engine head and in that there are two coolant circulation circuits, one between the block coolant jacket and the condenser chamber and one between the head coolant jacket and the condenser chamber.

In another embodiment the invention is characterized in that there is a second surface condenser chamber having condensing surfaces that include an external skin panel of a vehicle that is located at a level above the engine at all normal attitudes of the vehicle in operation. There are separate coolant jackets for the block and the head of the engine, and there are separate coolant circulation circuits, one between the first condenser chamber and the block coolant jacket and one between the second condenser chamber and the head coolant jacket.

A further embodiment is characterized in that there is no coolant jacket in the engine block and in that the inlet and outlet conduits are both connected between the condenser chamber and the head coolant jacket.

DESCRIPTION OF THE DRAWINGS

FIG. 5 is an end cross-sectional view in schematic form of a Wankel engine having a boiling liquid cooling system embodying the present invention;

FIG. 6 is a schematic side elevational view of the front end of an automobile equipped with the cooling system; and FIG. 7 is a schematic side elevational view of the front end of an airplane equipped with the cooling system.

MODES FOR CARRYING OUT THE INVENTION

Figure 1:
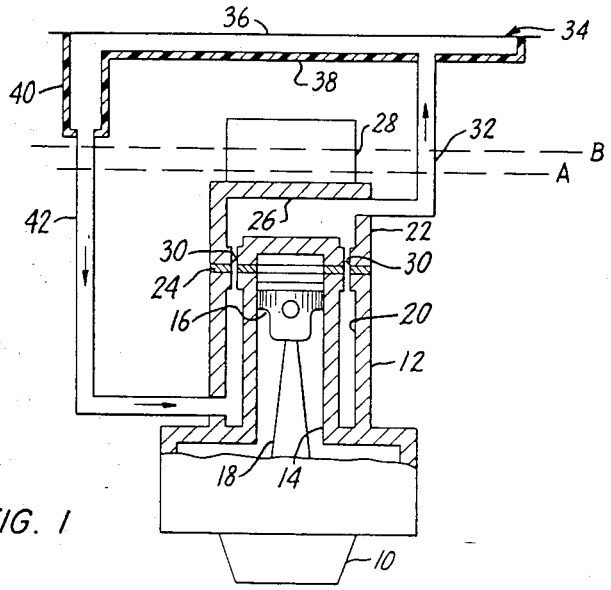
FIG. 1 is a schematic end cross-sectional view of a piston engine equipped with one embodiment of the cooling system according to the present invention.

The schematic depictions in FIGS. 1 through 4 of piston engines are intended to be representative of any state-of-the-art piston engine, whether it be an Otto cycle gasoline engine or a Diesel engine. In FIGS. 1 to 4, the corresponding major components of the engine are identified with the same reference numerals. Those basic components include an oil pan 10, a block 12 formed with one or more cylinders 14 in which pistons 16 reciprocate along a stroke length controlled by a crankshaft (not shown) and a connecting rod 18. Each cylinder 14 is surrounded by a block coolant jacket 20. A head 22 is bolted to the block 12 and is sealed to the block by a head gasket 24. The engine head 22 has a head coolant jacket 26. For the sake of simplicity, the intake and exhaust valves and the induction and exhaust ports constructed into the head are not shown. The reference numeral 28 represents the valve cover.

In the embodiment of the invention shown in FIG. 1 the block coolant jacket 20 communicates with the head coolant jacket 26 through passages 30. A conduit 32 is connected to the top of the head coolant jacket 26 and to a condenser chamber 34, the upper wall of which is a panel 36 of a material that has a comparatively high thermal conductivity. Any metal is entirely satisfactory, and plastics impregnated with metal powder to impart thermal conductivity can also be used. This form of heat exchanger chamber has advantages for use in vehicles such as automobiles, trucks, aircraft, locomotives and the like, because the panel 36 may be an external skin panel of the vehicle and thus be exposed to an air flow as the vehicle moves for enhanced removal of heat. The chamber 34 is further defined by a pan-like member 38 that is suitably joined and sealed to the panel 36. The pan-like member 38 can, for example, be strongly fastened to the panel 36 by an adhesive and a rolled crimped edge. The member 38 should have a high thermal conductivity in order to promote condensation of the vapor. The pan 38 of the chamber 34 includes a collector portion 40, and a condensate return conduit 42 leads from the collector portion back to the lower portion of the block coolant jacket 20.

Instead of having a vapor outlet conduit and a separate condensate return conduit, a single conduit leading from the top of the head to a low point in a condenser located above the head can serve both the vapor discharge and condensate return functions. Such an arrangement is shown in FIG. 6 and described below.

The coolant jackets 20 and 26 and the conduits 32 and 42 are filled with coolant to a level a short distance above the top of the head coolant jacket 26, as represented by the dashed line A in FIG. 1. As the engine warms up, the coolant expands, generally about 2 to 4 percent, so that the coolant level in the warmed-up engine rises to about the level represented by the dashed line B. The amount of coolant required for a cooling system embodying the present invention is much less than the amount required in a pumped liquid cooling system, inasmuch as very little coolant is ever present in the condenser. In a typical four cylinder engine, for example, the coolant fill is approximately three and one-half quarts. Because of the reduced amount of coolant, there is a reduced mass of coolant present to take heat from the engine during warm-up, and the engine warms up rapidly. Moreover, the warm-up is smoother than with a pumped liquid phase coolant system, inasmuch as there is no thermostat or equivalent element that causes variations in the flow rate, and thus the temperature of coolant being returned to the engine from the radiator, and hence tends to change the warm-up rate as the thermostat opens during the warm-up phase of operation. It is well known that the warm-up time in the operation of internal combustion engines is a period of low operating efficiency and is mechanically hard on the engine. The quick and smooth warm-up of the engine made possible with the cooling process of the present invention enhances engine efficiency, particularly in cold weather, and reduces wear.

From a cold start, the coolant in the head jacket 26 warms very quickly, say about one or two minutes, depending on ambient conditions. As heat is rejected by the engine into the cooling system, the temperature of the coolant can continue to rise until its boiling point is reached. At this level, the temperature of the engine stabilizes, as the temperature of the coolant can rise no further. Additional engine heat that is rejected into the cooling system causes liquid coolant to vaporize. The vapor is removed by convection from the area of its creation enabling liquid coolant to occupy its previous location. The heat contained in the coolant vapor is rejected through the exposed walls 36 and 38 of the condenser chamber as the vapor is condensed back to a liquid.

With the high saturation temperature, high molecular weight, low surface tension coolants used in the process of the present invention there are several benefits that ensure effective cooling of the engine head. For one thing, the low surface tension of the coolant ensures that only small vapor bubbles form and facilitates release of small vapor bubbles from the internal walls of the coolant jacket 26. The lower the surface tension of the coolant, the better. With a high saturation temperature coolant which has a surface tension lower than that of water when measured at 15° C. (59° F.) and recognizing that surface tension decreases as a function of increasing temperature and that the saturation temperature of the preferred coolant will be substiantially greater than the saturation temperature of water, the surface tension of the coolant is assured to be well below that of water at the saturation temperature. Due to the significantly reduced surface tension, more of the metal surface is wetted by coolant in the liquid phase, and there is more efficient heat transfer from the walls to the coolant.

A second advantage of these coolants is the low temperature difference between the saturation temperature of the coolant and the temperature of the metal of the engine head, which results in a greater level of nucleate boiling and a reduced level of film boiling of the coolant. The rate of heat transfer in a nucleate boiling situation is considerably greater than the rate of heat transfer in a film boiling situation. Accordingly, the rate of heat rejection by vaporization of the coolant is higher with the high boiling point, high molecular weight, low surface tension coolant than it is with water.

Tests have shown that the temperatures measured at external surfaces near critical heat areas of the cylinder head cooled with ethylene glycol or propylene glycol in the system depicted in FIG. 1 are about 17° C. (30° F.) lower than the temperature at the same location in the head for the same engine cooled with conventional water-antifreeze liquid coolant in a conventional pumped liquid cooling system. It is possible that there is a much greater difference between the temperatures at the internal head surfaces in the practice of the present invention and in the conventional system. It is believed that the reduced temperature results from a considerably more effective heat exchange between the metal of the head and the coolant with the present invention.

There is probably a considerable amount of boiling going on in the head coolant jacket of conventionally liquid-cooled engines at some interfaces between the metal and the liquid coolant. In some of these locations, the vapor thus formed becomes trapped, and the heat transfer rate from the metal to the liquid is thereby made very inefficient due to the presence of a vapor barrier between the metal and the liquid. Hence, the average temperature conditions throughout the head are somewhat higher than they are with the present invention. Such boiling in the head is particularly prevalent around the exhaust passages and near the exhaust valve seat areas of a conventionally liquid-cooled engine. With the coolants used in the present invention the vapor more readily leaves the wall and is more easily replaced by liquid for better heat transfer.

A third benefit of a high saturation temperature, high molecular weight coolant in the process of the invention is that the moles of vapor emitted for a given level of heat rejection can be substantially less than the moles of water vapor involved for the same heat rejection in a boiling water cooled engine. A reduction in the quantity of vapor produced is beneficial as it means a reduction in the ratio of vapor to liquid present throughout the system, i.e., the coolant jacket, the conduits and the condenser. Many organic liquids exhibit molar heats of vaporization which exceed that of water. Propylene glycol, for example, has a molar heat of vaporization about 20 percent greater than that of water. Thus, propylene glycol produces only about 80 percent as many moles of vapor as water would in removing the same amount of heat.

The coolants used according to this invention have saturation temperatures which exceed the temperatures seen over most of the internal surfaces of the block coolant jacket 20. This means that little or no vapor is produced in the block jacket, that any vapor produced recondenses rapidly and that the coolant conducted from the block jacket to the head jacket is substantially free of vapor and is therefore in the greatly preferred state for effective heat transfer. In short, the head coolant jacket does not have to serve as a conduit for the conduction of coolant vapor from the block as well as a temporary repository for vapor created in the head jacket itself, and therefore the vapor level in the head is believed to be substantially lower than in a boiling liquid coolant system using an aqueous coolant.

Coolant vapor produced in the head jacket 26 rises to the top of the jacket and passes out through one or more of the vapor discharge conduits 32, is released into the condenser 38 and rises by convection and momentum in the condenser up to the thermally conductive upper wall 36. At relatively low levels of vapor evolution from the coolant jacket 26 only a small fraction of the total surface area of the condenser appears to be contacted by vapor. Vehicles equipped with a cooling system in which the condenser is the entire vehicle hood exhibit significant heating of the surface area of the hood only to the extent of from about one quarter to half of the total surface area. From these observations it is concluded that a condenser chamber in which the entire surfaces of the hood panel 36 and the bottom pan 38 are available as condensing surfaces for the vapor has the capability of condensing as much vapor as the engine can generate under all temperature conditions and operating loads, with the possible exception in extreme circumstances of prolonged full load operation of the engine at low vehicle speeds in bright direct sun where solar heating of the hood surface can considerably reduce the condensing capacity of the vehicle hood. Even this extreme condition should be accommodated by applying a solar type clear reflective mono-directional coating to the hood or avoiding the use of heat-absorbing, dark colors for the hood of a vehicle operated in severe conditions.

Upon contact with the walls of the condenser, coolant vapor is condensed. The configuration and orientation of the pan 38 should be designed to promote reasonably rapid flow of the condensed coolant to the collector portion 40 and gravity return of the coolant through the return conduit 42 to the coolant jacket. Rapid return of the coolant to the engine is particularly desirable in cold ambient temperatures, in order to avoid substantial cooling of the condensate before it reaches the engine jacket. Otherwise, there will be a tendency for part of the coolant jacket receiving the condensate to be excessively cooled, thereby increasing the temperature gradient in the cylinder walls and somewhat reducing the advantages of the present invention that result from having more even temperatures throughout the full height of the cylinder walls.

A cooling system constructed to operate according to the process of this invention by utilizing a nonaqueous, high molecular weight, high temperature boiling point coolant may be designed to operate either with the condenser chamber vented to the atmosphere or with the system entirely closed. For a closed system, the pressure difference between the inside of the condenser and the outside of the condenser is a function of the average temperature of the enclosed volume at any given ambient pressure. The average temperature of the enclosed volume depends upon the quantity and temperature of the entering vapor, the effectiveness of the heat transfer of the condenser and the total volume enclosed by the condenser. Pressure and vacuum relief valves will be incorporated into a closed system in order to compensate for altitude changes or to protect the system in the event that volatile impurities such as water are present in or introduced into the coolant.

If the system is operated with the condenser vented to the atmosphere, the vent should be located at a cool location remote from the vapor inlet or inlets and in an upper part of the condenser chamber. As the preferred coolants for use in the process of this invention are of high molecular weight (molecular weight greater than 60), and the vapor is heavy relative to air (mw=28) and relative to water vapor (mw=18), the primary impurities (air and water vapor) are displaced by the heavier coolant vapor and are pushed out of the vent.

Engines equipped with the system depicted in FIG. 1 and operated with high molecular weight, high boiling point coolants have exhibited a reduction in hot spots, detonation and pre-ignition and a considerable reduction in the temperature gradient from top to bottom in the engine, improved fuel mileage and lower levels of emissions. Because of elevated, more even bore temperature distribution, engine lubrication is more efficient, wear is thus reduced and fuel economy improved. Because of the hotter bore temperatures in the block, water contamination, sludge, and acid formation in the lubricating oil are lower. The engines have been free of audible knock.

The condenser chamber itself can be constructed in various ways to provide rigidity. The pan will include stiffening ribs, certainly with myriad openings to allow vapor and liquid to move freely throughout the chamber. The pan can be joined in any suitable manner to the external body panel that forms the condensing surface. Modern adhesives are ideally suited for joining and sealing the pan to the body surface with rolled and crimped edges.

Systems designed for vehicles will have to include vapor and condensate conduit systems and a condenser that provide for taking vapor from the highest point in the head coolant jacket and for return of the condensate from the lowest point in the condenser for all normal operating attitudes of the vehicle. In some cases this will require providing two or more vapor discharge conduits 32 leading to the condenser and two or more return conduits leading from the condenser back to the engine, thus accommodating the system for good vapor and condensate flow paths in the circulating system for both uphill and downhill operation. In other cases it may suffice to use the same conduit or conduits for conducting vapor from the engine to the condenser chamber and for returning the condensate from the condenser to the engine. For example, a single conduit conducting vapor from the top of the head coolant jacket to the collector in the front lower portion of a condenser built into a sloped automobile hood can also conduct condensate in the opposite direction.

The geometry of the system should also be such to ensure that the fill level, which corresponds substantially to the horizontal regardless of the attitude of the vehicle, in the head coolant jacket is never allowed to drop below the top of the jacket 26 or at least maintains a liquid fill level throughout the head jacket that covers the exhaust ports and fills the major portion of the head jacket. Obviously, uncovering of the exhaust ports would lead to a very undesirable temperature build-up in the exhaust port or ports involved.

Figure 2:
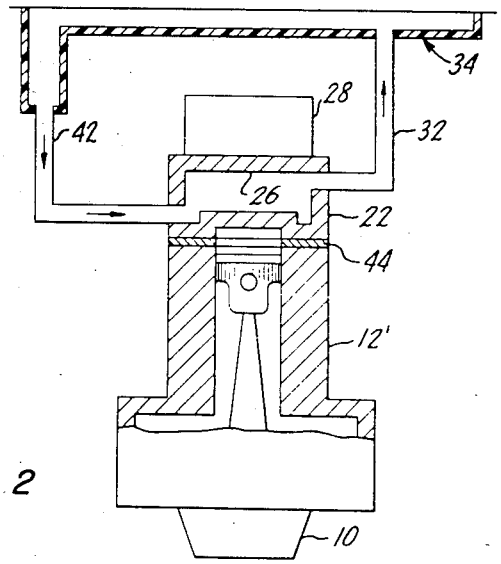
FIG. 2 is a schematic end cross-sectional view of a piston engine equipped with another embodiment of the present invention.

It is well known that the heat rejection into the coolant of an internal combustion engine occurs primarily in the head. Accordingly, as shown in FIG. 2, the present invention is applicable to an engine in which the engine block 12' is cooled by heat rejection through the metal walls of the cylinders to the outside air, and there are no coolant jackets around the cylinders. Indeed, the cylinders may have ceramic liners, and the block may be designed to retain heat in the cylinder walls, thereby to improve the thermodynamic efficiency of the engine cycle by minimizing heat rejection from the swept volume. In such an engine the high boiling temperature coolant fills only the head coolant jacket 26, and the engine head 22 is sealed to the block by a solid head gasket 44. One or more vapor discharge conduits 32 lead from the uppermost portion or portions of the head coolant jacket 26 to the condenser chamber 34, and one or more condensate return conduits 42 lead from the condenser chamber back to the coolant jacket 26.

With the embodiment of FIG. 2 the conduit 32 connecting the head coolant jacket 26 to the condenser chamber 34 may serve the dual functions of conducting vapor from the engine head to the condenser chamber and returning the condensate from the chamber to the coolant jacket. In all embodiments of the invention the conduit(s) used to conduct vapor from the head coolant jacket to the condenser chamber should be of relatively large diameter to ensure maximum freedom of evolution of the vapor phase coolant from the engine to the condenser chamber. Vapor conduction hoses or pipes of about one to two inches in diameter are typical for small displacement automotive engines. Obviously, systems for larger engines will benefit from larger conduits. Typically, condensate return hoses are ½" to ¾".

The operation of the system shown in FIG. 2 is essentially the same as the operation of the system shown in FIG. 1, in that all make-up coolant entering the head is in the liquid state. However, in the case of the embodiment of FIG. 2, condensed coolant is returned directly to the head coolant jacket 26 from the condenser chamber rather than returning via the block. The same advantages of a reduced level of vapor in the head and consequent better heat transfer conditions in the head coolant jacket are obtained with the embodiment of FIG. 2 as those obtained with the embodiment of FIG. 1.

Figure 3:
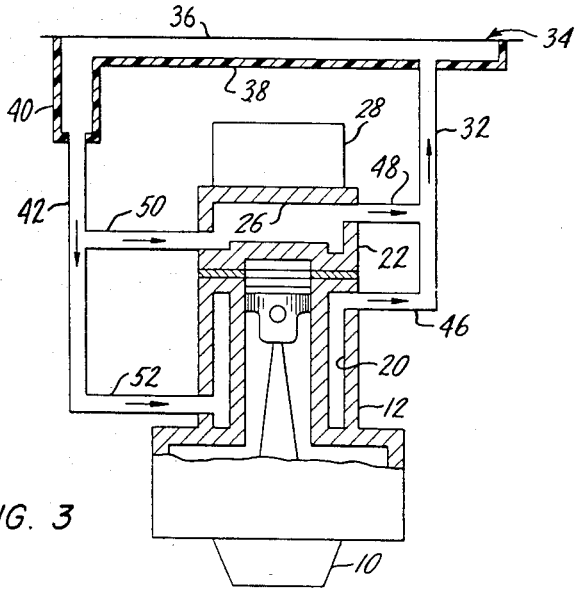
FIG. 3 is an end cross-sectional view in schematic form of a piston engine equipped with a third embodiment of the present invention.

With some engine designs and some coolants, it may happen that the coolant in the block coolant jacket reaches the saturation temperature. Instead of having coolant vapor flow from the block into the head coolant jacket, the vapor may be withdrawn separately from the block jacket and conducted to the condenser. An embodiment of such a system is shown in FIG. 3. Vapor from the block coolant jacket 20 passes through one or more branch conduits 46 connected to the uppermost portion or portions of the block coolant jacket. The branch conduits join the main vapor discharge conduit 32. A second branch conduit (or conduits) 48 connects the head coolant jacket 26 to the conduit 32. Accordingly, vapor is conducted separately from the block coolant jacket 20 and the head coolant jacket 26 to the condenser chamber 34. The condensate condensed in the condenser 34 is returned from the collector portion 40 through the main return conduit 42 which feeds a branch conduit 50 connected to the head coolant jacket 26 and a branch conduit 52 connected to the block coolant jacket 20. In the method as practiced in the system shown in FIG. 3, the condensate supplied to the head coolant jacket 26 via the branch conduit 50 is free of vapor, hence minimizing the amount of vapor in the head coolant jacket at all times, especially by reason of not supplying any vapor-laden coolant to the head jacket. The system shown in FIG. 3 is capable of operating with a coolant having a relatively low saturation temperature.

Figure 4:
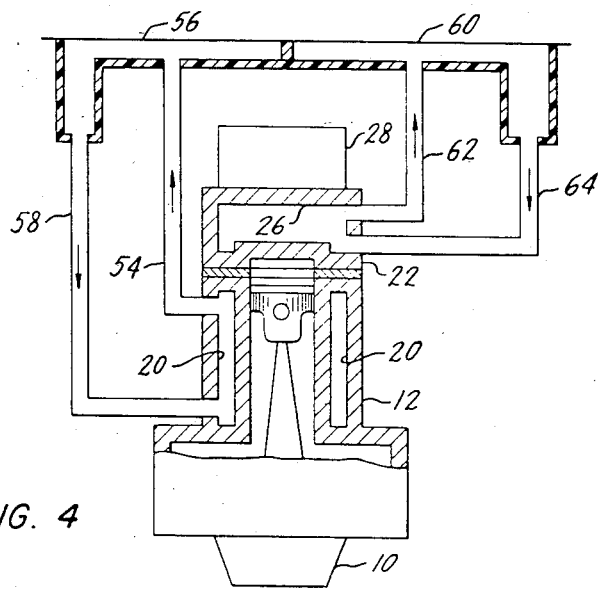
FIG. 4 is an end cross-sectional view in schematic form of a piston engine equipped with a fourth embodiment of the invention.

The system shown in FIG. 4 provides for the use of different coolants in the block coolant jacket and head coolant jacket. One or more vapor discharge conduits 54 are connected to the upper portion of the block coolant jacket 20 and provide for conduction of coolant vapor from the block jacket 20 into a first condenser 56. Condensed coolant is returned to the block through a conduit(s) 58. Coolant vapor produced in the engine head coolant jacket 26 is conducted into a second condenser 60 through a discharge conduit(s) 62, and the condensate in the chamber 60 is returned to the head coolant jacket 26 through a conduit(s) 64. The system shown in FIG. 4 is intended for use in an engine which is designed to have different operating temperatures in the block and the head. For example, for improved thermodynamic efficiency it may be desirable for the block to run at a higher temperature than the head, the head being kept at a lower temperature to prevent detonation, preignition or other undesirable effects of an excessively high temperature in the head portion of the engine. The higher temperature in the block ensures more complete combustion of the fuel as well as greater efficiency of the heat cycle of the engine because of reduced heat rejection. The cylinder walls may be lined with ceramic or other temperature-resistant liners, and the block may have insulated external walls. As this system would most likely be employed where the head and the block are to be maintained at two different temperatures, separate coolants would be chosen, each having the desired respective saturation temperature.

The two condenser chambers will, of course, be designed to provide the necessary condensing capacity for the respective coolant loops, namely the coolant loop for the head and the coolant loop for the block. As in the embodiments described above, the embodiment of FIG. 4 provides for supply of coolant in the liquid state to the head coolant jacket 26, thereby minimizing the ratio of vapor to liquid in the head jacket and ensuring efficient cooling under all environmental conditions and operating conditions.

In addition to using the method of the invention in piston internal combustion engines, the invention also can be used with other internal combustion engines. For example, FIG. 5 illustrates schematically a Wankel engine having a casing 60 that includes three separate coolant jackets 62, 64 and 66. The combustable mixture that powers the engine is taken in through an intake port 68, is compressed in the internal chamber 70 as the volume in the right portion of the chamber (with reference to FIG. 5) is swept by one of the surfaces of the rotor 72. The region near the spark plug or similar igniter 74 constitutes the head portion of the Wankel engine where the combustible fluid supplied to the engine is ignited and burned. A second swept volume of the chamber generally inwardly of the coolant jacket 66 is the expansion chamber where the working stroke of the engine occurs, the exhaust products of the combustion being discharged through an exhaust port 75 at the conclusion of the working stroke of each face of the rotor.

The highest point in each of the coolant jackets 62, 64 and 66 is connected by a vapor discharge conduit 76, 78 and 80, respectively, to a condenser chamber 82 mounted in a suitable location at a level above the engine. Vapor produced in each of the coolant jackets is conducted through the associated discharge conduit(s), is released into the condenser chamber, rises by convection and momentum up into contact with the thermally conductive upper wall 84 of the chamber and is condensed by heat exchange with the wall 84. The condensate falls onto the pan 86 of the condenser chamber, flows to the collector portion 88 and is returned through a common return conduit 90 to each of the respective coolant jackets 62, 64 and 66 through branch return conduits 92, 94 and 96.

In the general descriptions of this invention reference has always been made to the block coolant jacket and head coolant jacket of the engine. Inasmuch as the configuration of a Wankel engine differs from that of a piston engine, reference is made above to the swept volumes of the chamber 70. Portions of the casing 60 of the Wankel engine lying generally outwardly of the swept volumes are functionally equivalent to the cylinder block of a piston engine. It is intended that all references herein to the block coolant jacket be applicable to the coolant jackets 62 and 66 that are associated with the swept volumes of the Wankel engine. Similarly, it is intended that the coolant jacket 64 adjacent the combustion zone of the chamber 70 be understood to be the head coolant jacket of the Wankel engine. Hence the method of the present invention is practiced in the Wankel engine shown in FIG. 5 by virtue of the fact that liquid coolant is supplied from the condenser 82 in the liquid state to head jacket 64 adjacent the combustion zone, thereby establishing a favorable ratio of vapor phase coolant to liquid phase coolant in the head coolant jacket 64.

A modification of the embodiment of FIG. 5 that will be readily apparent to one skilled in the art in the light of the foregoing involves the provision of separate condenser chambers for each jacket in a manner analagous to the embodiment of FIG. 4. With such modification, each coolant jacket of the engine can be supplied with a different coolant, thereby enabling optimization of temperatures in the various zones of the engine for maximum thermodynamic efficiency and for attainment of other desirable mechanical characteristics such as reduced thermal stresses in the casing, good lubrication, more effective heat transfer rates and other objectives.

In a Wankel engine the exhaust port is at a location in the engine that is remote from the combustion zone, unlike Otto cycle and Diesel piston engines where the combustion zone and exhaust port are both in the head. Effective cooling of the exhaust port region of the Wankel engine casing is ensured by the fact that liquid coolant is supplied to both the jacket 66 and the jacket 62, either one of which may be joined to the jacket portion 98 that lies between the intake and exhaust ports 68 and 74. Accordingly, a low level of vapor is present in the region surrounding the exhaust port, thereby providing effective cooling for the exhaust port.

FIG. 6 illustrates the use of the invention in an automobile having a transverse mounted engine 102 located in an engine compartment that is covered by a hood 104. The hood 104 and a pan 110 define a condenser chamber 106 that receives vapor conducted from the top of the head coolant jacket through conduit 108. The vapor condenses in the chamber, and the condensate returns through the same conduit 108 to the head coolant jacket. The conduit 108 is a flexible hose that is suitably installed to allow the hood to be raised for access to the engine compartment. The nose 114 of the vehicle can be completely or largely closed, thus reducing drag. A small air intake may be provided to cool the engine compartment and oil pan.

In a system for an aircraft powered by a piston or Wankel engine(s), the condenser chamber may be in the roof of the fuselage or the top of the wing of an airplane or in the top of the body of a helicopter. FIG. 7 illustrates an airplane 120 having engines 122 installed in pods 124 under the wings 126. The condenser chambers 128 are built into the upper wing surfaces generally above the engine so that the propeller wash will provide a cooling air flow over the external cooling panel when the plane is on the ground. Generally, aircraft cooling systems embodying the present invention will have small pumps for returning condensate to the engine from condensate collectors at the four corners of the condenser chambers, inasmuch as the system must accommodate considerable pitch and roll motions. A by-product function of wing surface condensers is de-icing.

In the general description of this invention reference has often been made to "the saturation temperature" and to "the boiling point". These designations are correctly used with reference to properties of pure coolant substances or azeotropic mixtures since for non-azeotropic mixtures boiling occurs over a range of temperatures with the lowest temperature, called the bubble point, and the highest temperature, called the dew point. In practice liquids used for coolants according to this invention may not be entirely pure substances or azeotropic mixtures inasmuch as they may contain additives such as stabilizers, inhibitors, and coloring agents, and they may contain impurities such as water or other unintended ingredients. Further, a coolant formulated for use with this system may consist of a mixture of substances which might cause the liquid to exhibit a boiling range and hence a range of saturation temperatures.

What is claimed is:

1. A cooling system for an internal combustion engine, the engine including a coolant jacket, and having a condenser and conduit means for conducting coolant vapor from substantially the highest zone in the coolant jacket to the condenser and for returning coolant condensate to the coolant jacket characterized in that the coolant is a high molecular weight organic liquid having a saturation temperature at atmospheric pressure of not less than about 132° C. (270° F.), a molar heat of vaporization at atmospheric pressure of greater than about 9,800 cal/mole and a surface tension at 15° C. (59° F.) of less than about 70 dynes/cm.

2. A cooling system according to claim 1 and further characterized in that the coolant consists essentially of a member selected from the group consisting of ethylene glycol, propylene glycol, tetrahydrofurfuryl alcohol, dipropylene glycol and 2,2,4-trimethyl-1,3-pentanediol monoisobutyrate.

3. A cooling system according to claim 1 and further characterized in that there are separate coolant jackets for the engine block and the engine head, and in that there are two coolant circulation circuits, one between the block coolant jacket and the condenser chamber and one between the head coolant jacket and the condenser chamber.

4. A cooling system according to claim 1 and further characterized in that there is a second condenser chamber, in that there are separate coolant jackets for the block and the head of the engine, and in that there are separate coolant circulation circuits, one between the first condenser chamber and the head coolant jacket and one between the second condenser chamber and the block coolant jacket.

5. A cooling system according to claim 1 and further characterized in that there is no coolant jacket in the engine block and in that the outlet and inlet conduits are both connected between the condenser chamber and the head coolant jacket.

6. A boiling liquid cooling process for internal combustion engines in which coolant vapor is conducted from substantially the highest zone in the engine coolant jacket to a condenser, is condensed and the condensate is returned from the condenser to the engine, characterized by the step of under all operating conditions of the engine supplying coolant exclusively in a liqud state substantially free of vapor to the coolant jacket of the engine head such that the major part of the head coolant jacket is kept filled with coolant in the liquid phase at all times, the coolant being a boilable organic liquid having a saturation temperature at atmospheric pressure of not less than about 132° C. (270° F.), a molar heat of vaporization at atmospheric pressure of greater than about 9,800 cal/mole and a surface tension at 15° C. (59° F.) of less than 70 dynes/cm.

7. A process according to claim 6 and further characterized in that the coolant contains in major portion a member of the group consisting of ethylene glycol, propylene glycol, tetrahydrofurfuryl alcohol, dipropylene glycol and 2,2,4-trimethyl-1,3-pentanediol monoisobutyrate.

8. A process according to claim 6 and further characterized in that the differential pressure between a vapor outlet from the engine head coolant jacket to a condenser and a liquid outlet from the condenser is kept at not greater than about 7 kPa (1 psi).

9. A process according to claim 6 and further characterized in that the coolant is supplied to the head coolant jacket by gravity from a vapor condenser having a condensate collection and outlet portion above the top of the head coolant jacket and in that a coolant return conduit means from the condensate outlet portion to the head coolant jacket is at all times filled with coolant to a level above the top of the coolant jacket.

10. A process according to claim 6 and further characterized in that the engine has head and block coolant jackets that communicate with each other, in that the condensate is returned to the block coolant jacket, and in that liquid coolant is supplied as a liquid to the head coolant jacket from the block coolant jacket.

11. A process according to claim 6 and further characterized in that coolant condensate is returned from the condenser directly to the head coolant jacket of the engine.

12. A process according to claim 6 and further characterized in that the engine does not have a block coolant jacket and in that coolant condensate is returned from the condenser directly to the head coolant jacket.

13. A process according to claim 6 and further characterized in that the engine has a block coolant jacket that is separate from the head coolant jacket, in that one vapor condenser receives coolant vapor from the head coolant jacket and returns condensate to the head coolant jacket, and in that a second vapor condenser receives coolant from the block jacket and returns coolant condensate to the block coolant jacket.

14. A process according to claim 6 and further characterized in that the engine has a block coolant jacket that is separate from the head coolant jacket and in that coolant vapor is conducted from both the head coolant jacket and the block coolant jacket to the condenser and coolant condensate is returned from the condenser to both the head coolant jacket and block coolant jacket.

* * * * *